US007055787B2

(12) United States Patent
Cross

(10) Patent No.: US 7,055,787 B2
(45) Date of Patent: Jun. 6, 2006

(54) SHEET MATERIAL CLAMP

(76) Inventor: Christopher Todd Cross, 7 Yellow Locust La., Littleton, CO (US) 80127

( * ) Notice: Subject to any disclaimer, the term of this patent is extended or adjusted under 35 U.S.C. 154(b) by 93 days.

(21) Appl. No.: 10/766,516

(22) Filed: Jan. 27, 2004

(65) Prior Publication Data

US 2005/0001369 A1 Jan. 6, 2005

Related U.S. Application Data

(60) Provisional application No. 60/442,856, filed on Jan. 27, 2003.

(51) Int. Cl.
*A47B 96/00* (2006.01)

(52) U.S. Cl. ..... 248/226.11; 248/226.6; 269/37; 269/41; 269/152; 269/249

(58) Field of Classification Search ..... 248/226.11, 248/229.15, 229.25, 228.6, 231.71, 316.4, 248/316.6; 269/37, 41, 152, 249
See application file for complete search history.

(56) References Cited

U.S. PATENT DOCUMENTS

| | | | | |
|---|---|---|---|---|
| 2,322,107 | A * | 6/1943 | Balcar | 269/224 |
| 4,553,872 | A * | 11/1985 | Chandra et al. | 403/25 |
| 4,828,241 | A * | 5/1989 | Yang | 269/114 |
| 5,573,228 | A * | 11/1996 | Chestnut | 269/41 |
| 5,586,378 | A * | 12/1996 | Smith | 29/257 |
| 6,098,973 | A * | 8/2000 | Khachatoorian | 269/182 |
| 6,296,241 | B1 * | 10/2001 | Harrison | 269/249 |
| 6,726,193 | B1 * | 4/2004 | Yates | 269/184 |

* cited by examiner

*Primary Examiner*—Ramon O Ramirez
(74) *Attorney, Agent, or Firm*—Swanson & Bratschun LLC

(57) ABSTRACT

A sheet material clamp having a rigid clamp base of a pre-selected length. The rigid clamp base has a clamping surface and at least two clamping apparatus attached to the clamping base for applying clamping pressure through a pressure foot toward the clamping surface. The apparatus for applying clamping pressure are spaced along the length of the clamp base so that clamping pressure can be applied evenly along the edge of the sheet material being clamped.

20 Claims, 2 Drawing Sheets

SHEET MATERIAL CLAMP

RELATED APPLICATIONS

This application claims priority from U.S. Provisional Patent Application Ser. No. 60/442,856, filed Jan. 27, 2003, entitled "Sheet Material Clamp."

BACKGROUND OF THE INVENTION

1. Technical Field

The present invention is directed toward a sheet material clamp and more particularly toward a sheet material clamp with multiple clamping structures positioned lengthwise along a clamping surface.

2. Background Art

It is customary in the building and construction trades to install countertops in various residential and commercial building locations such as kitchens, bathrooms or office workspaces. Relatively simple countertop designs can be fabricated offsite and installed by a finish carpenter as delivered. In the alternative, more highly specialized countertops are often fabricated from sheet materials onsite as part of the installation process. This second onsite method of installation and fabrication is typically used in more highly customized applications such as luxury homes. Custom countertops which are fabricated onsite can be created from laminated wood products, stone or specialized plastic sheet materials.

In many installations it is desired to bond a double thickness of the sheet material being used to the front edge of the countertop. The double thickness material along the front edge of a countertop can provide a more durable and aesthetically appealing edge surface toward the living or high use area. In addition, the use of a relatively thin length of material to form the double thickness edge can provide a significant overall savings of material costs.

Typically, the two portions of sheet material which are being bound together to form a double thickness edge are affixed to each other with an adhesive specially formulated for the material in use. Clamping pressure must be applied along the front edge of the countertop to assure that the sheet materials being bound are held in close proximity while the adhesive sets. A row of C-clamps along the countertop edge can be used to apply the necessary clamping pressure. However, the use of C-clamps in this application can be difficult since numerous separate clamps must be applied along the countertop edge and it can be difficult to get an even application of pressure along the edge with a series of individual clamps. In addition the installation of individual clamps requires the countertop craftsman to position and tighten multiple clamps quickly as appropriate clamping pressure must be applied before the adhesive begins to set. It is quite possible through the inexpert use of C-clamps to ruin a countertop edge by not applying pressure evenly and quickly enough.

In many custom countertops, the countertops have curved edges and the curved edges can vary from inner and outer radii or corners and straight edges. These complicated edge configurations can further enhance the risk of ruining countertop edges by not applying suitable pressure.

The present invention is directed toward overcoming one or more of the problems discussed above.

SUMMARY OF THE INVENTION

One aspect of the present invention is a sheet material clamp having a rigid clamp base of a pre-selected length. The length of the clamp base should substantially equal or exceed the length of the countertop edge being clamped. The rigid clamp base has a clamping surface running along its length and at least two clamping apparatus rigidly bonded to the clamping base. The clamping apparatus function by applying clamping pressure through a pressure foot toward the clamping surface. The apparatus for applying clamping pressure are preferably spaced along the length of the clamp base so that clamping pressure will be applied evenly along the edge of the countertop being fabricated.

The apparatus for applying clamping pressure can feature a captive C-clamp type design with a female threaded socket formed in a claming frame and a mating male threaded shaft. The male shaft can be attached at one end to the pressure foot and have a handle associated with the other end. In this configuration turning the handle similar to the operation of a C-clamp will drive the pressure foot toward the clamping surface. Alternatively the apparatus for applying clamping pressure can be a fluid driven actuator such as a hydraulic or pneumatic cylinder, or alternatively an electromechanical motor. The actuator can be operatively associated with a shaft connected to the pressure foot so that application of power to the actuator drives the pressure foot toward the clamping surface.

In a highly preferred embodiment, the rigid clamp base consists of a number of lengthwise segments joined in series by hinges that enable pivotal movement of the various lengthwise segments relative to one another. The rigid clamp base can be made of a substantially elongate rectangular bar or a channel member having a channel opening sized to receive layered sheet material to be clamped, and either the rectangular bar or the channel member can be divided into lengthwise segments and joined by hinges as described above.

The present invention provides a sheet material clamp which can be used to efficiently and quickly apply clamping pressure to two lengthwise portions of sheet material which are being bonded together. In addition, the sheet material clamp is optimized to provide pressure which is evenly distributed along the length of the materials being bonded. Furthermore, the present invention provides a clamp structure that can quickly clamp edges having inner or outer corners or radii.

DETAILED DESCRIPTION OF THE PREFERRED EMBODIMENT

Figure 1:
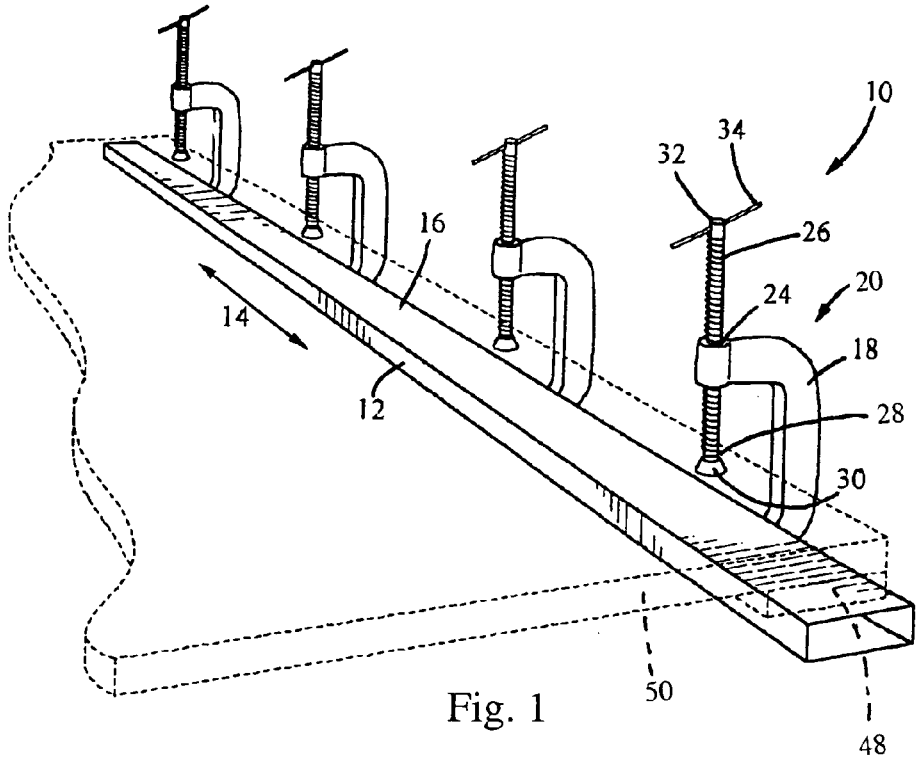
FIG. 1 is a perspective view of the sheet material clamp featuring manually actuated clamping means.
Figure 2:
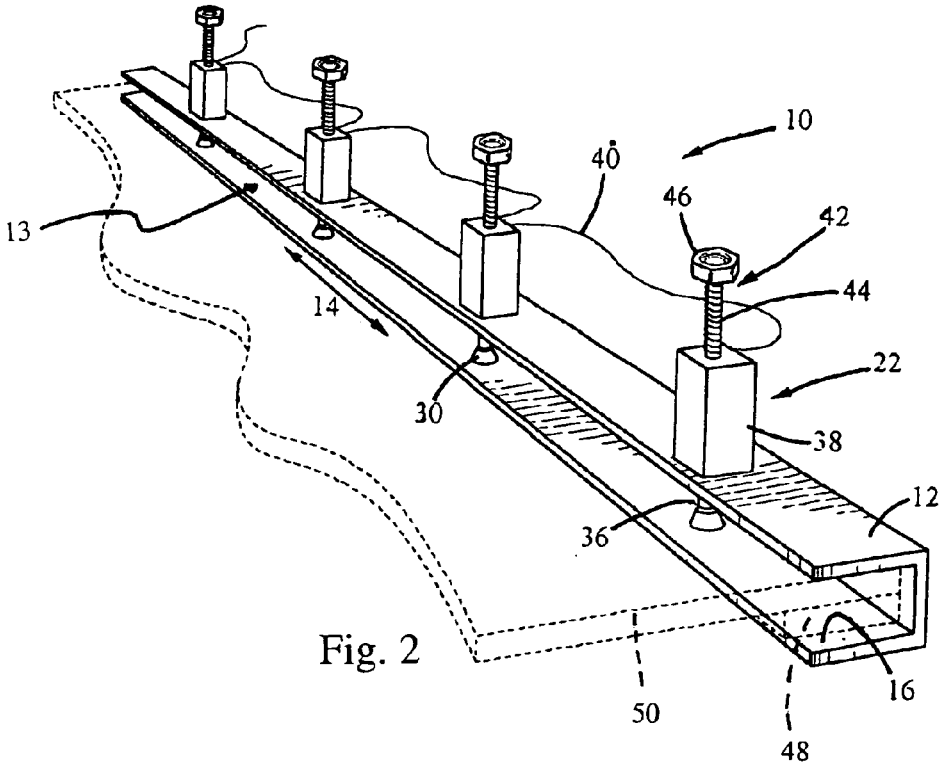
FIG. 2 is a perspective view of the sheet material clamp featuring fluid actuated clamping means.

A sheet material clamp 10 includes a rigid clamp base 12 having a select length 14 and a clamping surface 16. As shown in FIG. 1 the rigid clamp base 12 can be a substantially elongate rectangular bar to which clamping structures 18 are attached at specified intervals along the rigid clamp base 12. In the alternative, as shown in FIG. 2, the rigid clamp base 12 can be fabricated as a channel member having a channel opening 13 sized to receive layered sheet material which will be clamped within the interior of the channel. As illustrated in FIGS. 1 and 2, the clamping structures are rigidly attached to the clamp base at select intervals. Alternatively, the clamping structures can be attached in a manner that enables them to slide lengthwise relative to the rigid clamp base 12. For example, each clamping structure could be mounted in a lengthwise groove in a rail on the clamp base 12, as discussed below with reference to FIGS. 3 and 4.

In either embodiment the length 14 of the rigid clamp base 12 preferably should equal or exceed the length of the sheet material edge being clamped. Alternatively, multiple sheet material clamps can be used in series where the length of the sheet material edge being clamped exceeds the length 14.

In one embodiment of the present invention clamping pressure is applied by use of a manual clamping system 20. This embodiment is depicted in FIG. 1. In a preferred embodiment of the present invention clamping pressure is applied automatically and simultaneously at each clamping point by use of an automatic clamping system 22. This embodiment is shown in FIG. 2. It is important to note that although the manual clamping system 20 is shown with a bar type rigid clamp base 12, and the automatic clamping system 22 is shown with a channel type rigid clamp base 12, either type of clamping system can be used with either type base 12.

Referring again to FIG. 1, the manual clamping system 20 consists of a female threaded socket 24 formed in the portion of the clamping structure 18 opposite the clamping surface 16. In addition a male threaded shaft 26 is matingly engaged with the female threaded socket 24.

The threaded shaft 26 when engaged in the operative position has a first end 28 facing toward the clamping surface 16. The first end 28 of the threaded shaft 26 is operatively associated with a pressure foot 30. The male shaft 26 has in addition a second end 32 opposite the first end 28. The second end 32 of the male shaft 26 is operatively associated with a handle 34.

As depicted in FIG. 2, the automatic clamping system 22 also features a pressure foot 30 which is attached to a drive shaft 36. The drive shaft 36 is operatively associated with a fluid driven actuator 38 which can be a pneumatic or hydraulic device. That is, as used herein, "fluid" means any suitable compressible gas or incompressible liquid, depending upon whether the system is pneumatic or hydraulic. Fluid is supplied to the fluid driven actuator 38 by supply line 40. In addition a supplemental tightening device 42, consisting of a shaft 44 and knob (or nut) 46 can be associated with each fluid driven actuator 38.

In an alternative analogous embodiment not shown on FIG. 1 or FIG. 2, the automatic clamping system 22 could consist of an electromechanical actuation device or any other type of actuator for selectively advancing the pressure foot 30.

With the sheet material clamp 10 assembled as described above, the system functions as follows: Two elongate pieces of sheet material stock 48, 50, (typically with one 48 being significantly narrower than the other 50) are positioned juxtaposed for bonding as shown in phantom lines in FIG. 1, forming a double thickness edge. Adhesive is applied to the bonding surfaces of one or both pieces of sheet material 48, 50. If the manual sheet material clamp of FIG. 1 is employed, the handle 34 associated with each male threaded shaft 26 is rotated in the clockwise or counterclockwise direction, as is necessary to back the pressure foot 30 away from the clamping surface 16 a sufficient distance to allow placement of the sheet material clamp 10 over the two pieces of sheet material which are to be bound. The handle 34 is then rotated in a clockwise or counterclockwise direction as is necessary to advance the male threaded shaft 26 and associated pressure foot 30 toward the clamping surface, thereby applying clamping pressure to the two pieces of sheet material received between the clamping surface 16 and the pressure foot 30. Care must be taken by the craftsman applying the clamp 10 to assure that even pressure is applied along the length of the countertop edge.

An alternative preferred embodiment features use of the automatic clamping system 22 as shown in FIG. 2. In this embodiment, the pressure foot 30 and associated drive shaft 36 are backed either manually or automatically into the fluid driven actuator 38 opening a space between the pressure foot 30 and the clamping surface 16 wide enough to receive the double thickness countertop edge 48, 50. The sheet material clamp 10 is placed over the double thickness countertop edge with the edge being received within the channel of the rigid clamping base 12 as depicted in FIG. 2. At this point, pressure is applied to each pressure foot 30 simultaneously by actuation of each interconnected fluid drive actuator 38, thereby applying clamping pressure to the double thickness countertop edge received between the pressure foot 30 and the clamping surface 16. In addition, it may be desirable to apply clamping pressure to the sheet materials received within the clamp in excess of that generated by the fluid driven actuator 38. In such case the craftsman can apply supplement pressure by tightening the supplemental tightening device 42 associated with each automatic clamping system 22.

Figure 3:
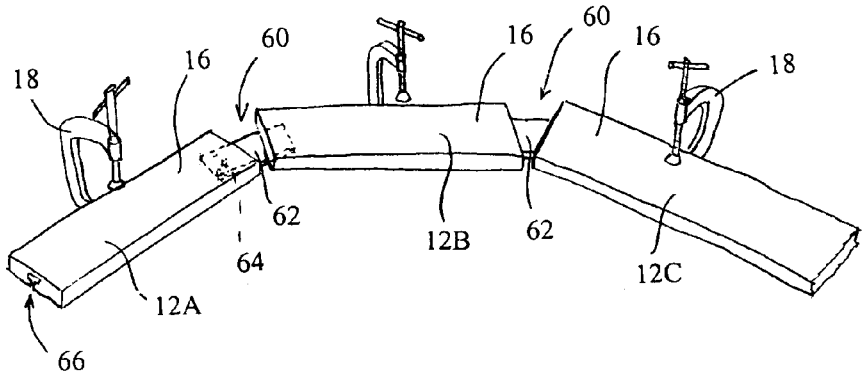
FIG. 3 is perspective view of an alternate embodiment of the sheet material clamp featuring manually actuated clamping means of FIG. 1 with the base broken into lengthwise segments.

FIG. 3 depicts a manual clamping system similar to FIG. 1, although differing in that the rigid clamp base 12 is broken into a number of lengthwise clamp base segments, 12A, 12B and 12C, each having a clamping surface 16 joined in series by a hinge 60 so that lengthwise segments 12A, 12B and 12C are pivotable relative to each other while maintaining the clamping surfaces 16 substantially coplanar. The hinge 60 preferably consists of a plate 62 that is attached to each of the adjacent lengthwise segments by a bolt 64 or some other known attachment device enabling the various lengthwise segments 12A, 12B and 12C to pivot relative to the plate 62 and each other. The bolt 64 preferably does not protrude through surface 16.

Referring further to FIG. 3, and in particular to lengthwise segment 12A, each lengthwise segment may be provided with a T-shaped groove 66 in a surface opposite the clamping surface 16. In this embodiment, each clamping structure 18 has a foot (not shown) configured to be received within the T-shaped slot 66 so as to slide lengthwise of the segment without becoming detached from the segment. Ideally a weld or some other obstruction would be provided at each end of the T-shaped groove 66 to prevent the clamping structure 18 from sliding out lengthwise from the T-shaped groove 66.

As shown in FIG. 3, lengthwise segments 12A and 12B are substantially the same length. Numerous other segments of substantially the same length could be attached in series with segments 12A and 12B as desired. 12C is shown being greater length than 12A or 12B. 12C could be of any desired length and have a number of clamping structures 18 associated therewith, basically having a configuration identical to that illustrated in FIG. 1. In this manner, the embodiment illustrated in FIG. 3 can be used for clamping sheet material stock 48, 50 having a straight edge as illustrated in FIG. 1 or having inside or outside curved edges so as to accommodate virtually any edge curvature or inside or outside corners.

Figure 4:
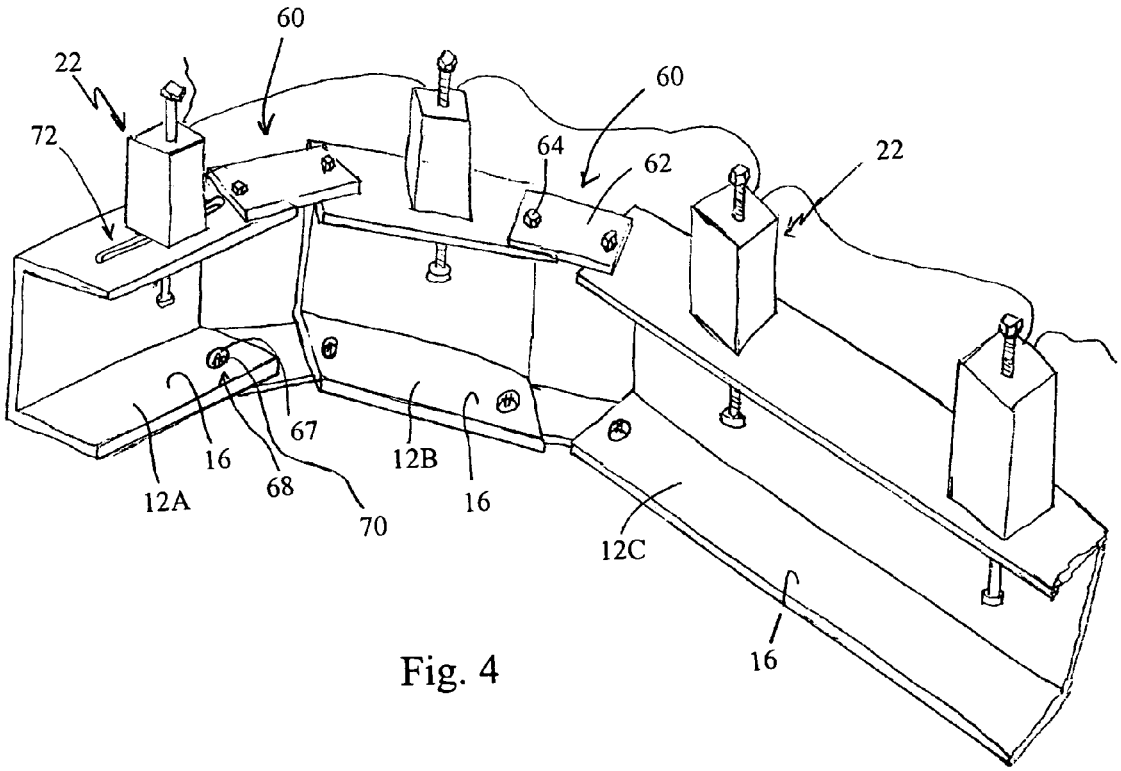
FIG. 4 is a perspective view of an alternate embodiment of the sheet material clamp featuring fluid actuated clamping means of FIG. 2 broken into lengthwise segments.

FIG. 4 is somewhat similar to FIG. 2 although it is modified by the channel member being in lengthwise segments joined by hinges 60 in the same manner and for the same purpose as discussed above with respect to FIG. 3. While FIG. 4 shows a top and bottom hinge, a single top or bottom hinge or a back plate hinge are within the spirit of the invention. The plates 62 are similarly attached by bolts 64 to allow pivoting between the lengthwise segments 12A, 12B and 12C. As likewise described above with respect to FIG. 3, the bolts or pivotal attachments 64 are attached in a manner to prevent interference with the substantially coplanar clamping surfaces 16. For example, as seen in FIG. 4, the bolt or attachment structure 64 could be a pin 67 received in a countersunk bore 68 and secured therein with a cotter pin 70, all of which resides within the countersunk bore below the clamping surface 16. Other suitable hinge structures could be substituted. In the embodiment illustrated in FIG. 4, the automatic clamping system 22 allows each of the clamps to be simultaneously actuated. Referring to segment 12A, a lengthwise slot 72 may receive an automatic clamping system 22 to allow the automatic clamping system 22 to slide lengthwise of the segment 12A. Such a slot could be provided in each of the segments 12A, 12B and 12C to allow the automatic clamping systems to be moved lengthwise as desired by the user. Alternatively, as illustrated with respect to lengthwise segments 12B and 12C, the automatic clamping systems 22 can be fixedly attached to each lengthwise segment at a select lengthwise spacing.

The clamping systems described herein allow a fabricator to quickly and easily adhere juxtaposed sheet material stock without having to fumble with multiple clamps. A user need simply align the various embodiments along juxtaposed edges with adhesive therebetween to be secured and the clamps can be readily fastened. The embodiments illustrated in FIGS. 2 and 4 including the automatically clamping system are particularly advantageous because of the speed and uniformity with which pressure can be applied to the juxtaposed edges. The embodiments illustrated in FIGS. 3 and 4 have particular advantages because they can be used to attach curved edges, whether they have inner or outer radii or corners. Including the feature of the clamps being slidable relative to the rigid clamp base allows adjustability that may be advantageous in particular applications. Significantly, all of the illustrated embodiments can be readily manufactured from conventional steel, aluminum or other metal alloy channel or plate stock to minimize cost of the sheet material clamp systems describe herein. Other materials that are sufficiently rigid could be substituted for the metals discussed above. Thus, the many advantages described herein can be provided through inexpensive off-the-shelf commodity materials and easily assembled by workers of limited skill.

What is claimed is:

1. A sheet material clamp comprising:

a rigid clamp base having a select length and a clamping surface;

at least two means for applying clamping pressure attached to the rigid clamp base, each means for applying clamping pressure being spaced along the length of the rigid clamp base and at least one of the means for applying clamping pressure being attached to the rigid clamp base in a manner enabling it to move lengthwise relative to the clamp base; and a pressure foot operatively associated with each means for applying clamping pressure, the pressure foot configured such that actuation of the means for applying clamping pressure drives the pressure foot toward the clamping surface.

2. The sheet material clamp of claim 1 wherein each means for applying clamping pressure comprises:

a female threaded socket formed in a clamping frame;

a mating male threaded shaft, threaded through the female threaded socket, the male threaded shaft having a first end operatively associated with the pressure foot, and a second end opposite the first end; and a handle operatively associated with the second end of the male threaded shaft configured such that rotation of the handle can drive the pressure foot toward the clamping surface.

3. The sheet material clamp of claim 2 wherein the clamp base is a substantially elongate rectangular bar.

4. The sheet material clamp of claim 2 wherein the clamp base is a channel member having a channel opening sized to receive at least two juxtaposed sheets of sheet material therein.

5. The sheet material clamp of claim 1 wherein each means for applying clamping pressure comprises:

an actuator;

a drive shaft operatively associated with the actuator; and the pressure foot being operatively associated with the drive shaft such that actuation of the actuator advances the drive shaft and thereby drives the pressure foot toward the clamping surface.

6. The sheet material clamp of claim 5 wherein each actuator is fluid driven.

7. The sheet material clamp of claim 5 wherein each actuator is fluid driven and part of a single fluid circuit, whereby each actuator is substantially simultaneously actuated by application of fluid pressure to the circuit.

8. The sheet material clamp of claim 5 wherein the clamp base is a substantially elongate rectangular bar.

9. The sheet material clamp of claim 5 wherein the clamp base is a channel member having a channel opening sized to receive at least two juxtaposed sheets of sheet material therein.

10. The sheet material clamp of claim 1 wherein the clamp base is a substantially elongate rectangular bar.

11. The sheet material clamp of claim 10 wherein the clamp base comprises at least two lengthwise clamp base segments each having a clamping surface joined in series by a hinge, whereby lengthwise segments are pivotable lengthwise relative to each other while maintaining each clamping surface substantially coplanar.

12. The sheet material clamp of claim 1 wherein the clamp base is a channel member having a channel opening sized to receive at least two juxtaposed sheets of sheet material therein.

13. The sheet material clamp of claim 12 wherein the clamp base comprises at least two lengthwise clamp base segments each having a clamping surface joined in series by a hinge, whereby lengthwise segments are pivotable lengthwise relative to each other while maintaining each clamping surface substantially coplanar.

14. The sheet material clamp of claim 13 where a hinge is operatively associated with each clamp base segment on opposite sides of the channel opening.

15. The sheet material clamp of claim 1 wherein the clamp base comprises at least two lengthwise clamp base segments each having a clamping surface joined in series by a hinge, whereby lengthwise segments are pivotable lengthwise relative to each other while maintaining each clamping surface substantially coplanar.

16. The sheet material clamp of claim 15 wherein at least one means for applying clamping pressure is attached to each clamp base segment.

17. The sheet material clamp of claim 16 wherein each means for applying clamping pressure comprises:

a female threaded socket formed in a clamping frame;

a mating male threaded shaft, threaded through the female threaded socket, the male threaded shaft having a first end operatively associated with the pressure foot, and a second end opposite the first end; and a handle operatively associated with the second end of the male threaded shaft configured such that rotation of the handle can drive the pressure foot toward the clamping surface.

18. The sheet material clamp of claim 16 wherein each means for applying clamping pressure comprises:

an actuator;

a drive shaft operatively associated with the actuator; and the pressure foot being operatively associated with the drive shaft such that actuation of the actuator advances the drive shaft and thereby drives the pressure foot toward the clamping surface.

19. A sheet material clamp comprising:

a rigid clamp base having a select length and a clamping surface;

at least two means for automatically and substantially simultaneously applying clamping pressure attached to the rigid clamp base, each means for applying clamping pressure being spaced along the length of the rigid clamp base; and a pressure foot operatively associated with each means for applying clamping pressure, the pressure foot configured such that actuation of the means for applying clamping pressure drives the pressure foot toward the clamping surface, wherein each means for applying clamping pressure comprises:

an actuator;

a drive shaft operatively associated with the actuator; and the pressure foot being operatively associated with the drive shaft such that actuation of the actuator advances the drive shaft and thereby drives the pressure foot toward the clamping surface.

20. The sheet material clamp of claim 19 wherein each actuator is fluid driven and part of a single fluid circuit, whereby each actuator is substantially simultaneously actuated by application of fluid pressure to the circuit.

* * * * *